US006371831B1

(12) United States Patent
Dodge

(10) Patent No.: US 6,371,831 B1
(45) Date of Patent: Apr. 16, 2002

(54) STRAPLESS SWIMSUIT TOP AND METHOD OF DONNING SAME

(76) Inventor: Holly A. Dodge, 250 Sayebrook Tr., New Smyrna Beach, FL (US) 32168

( * ) Notice: Subject to any disclaimer, the term of this patent is extended or adjusted under 35 U.S.C. 154(b) by 0 days.

(21) Appl. No.: 09/938,024

(22) Filed: Aug. 24, 2001

(51) Int. Cl.[7] ..... A41C 3/00
(52) U.S. Cl. ..... 450/81; 450/57; 2/67
(58) Field of Search ..... 450/81, 57, 37, 450/39; 2/67, 69, 267

(56) References Cited

U.S. PATENT DOCUMENTS

| | | | | | |
|---|---|---|---|---|---|
| 1,783,512 | A | * | 12/1930 | Mather | 450/81 |
| 2,553,825 | A | | 5/1951 | Langs | |
| 2,596,567 | A | | 5/1952 | Langs | |
| 2,728,079 | A | | 12/1955 | Williams | |
| 2,869,553 | A | * | 1/1959 | D'Or | 450/81 |
| 3,276,449 | A | * | 10/1966 | Morgan | 450/81 |
| 3,280,818 | A | * | 10/1966 | Pankey et al. | 450/81 |
| 3,297,036 | A | | 1/1967 | Williams | |
| 3,749,102 | A | | 7/1973 | Wynants | |
| 4,333,471 | A | * | 6/1982 | Nakai | 450/81 X |
| 4,553,550 | A | | 11/1985 | Hattori | |
| 4,640,288 | A | | 2/1987 | Hattori | |
| 5,782,672 | A | | 7/1998 | Woodley | |
| 6,183,340 | B1 | | 2/2001 | Wen | |
| 6,241,715 | B1 | * | 6/2001 | Houser et al. | 450/81 X |

* cited by examiner

*Primary Examiner*—Gloria M. Hale
(74) *Attorney, Agent, or Firm*—Paul S. Rooy

(57) ABSTRACT

A strapless swimsuit top and method of donning same. The strapless swimsuit top comprises waterproof adhesive attached to a fabric cup sized and shaped to admit a female breast. The waterproof adhesive co-extends with the fabric except in an adhesive-free nipple area. An adhesive backing sheet co-extends with the adhesive and protects the adhesive until such time as the strapless swimsuit top is to be installed. Steps of donning the strapless swimsuit top include removing the adhesive backing sheet, sliding a strapless swimsuit top lower edge upwards over a thorax towards a breast lower surface, positioning the strapless swimsuit top lower edge at an intersection of the thorax and breast lower surface such that the adhesive-free nipple area is directly below a nipple, and a sufficient distance away from the nipple that when the strapless swimsuit top is rolled up over the breast, the adhesive-free nipple area will coextend with the nipple; rolling the strapless swimsuit top up over the breast, taking care to ensure that the nipple is covered by the adhesive-free nipple area, whereby contact between said waterproof adhesive is avoided, thereby preventing chafing and irritation of the nipple. The strapless swimsuit top may optionally be pulled upwards during attachment to provide uplifted and supported to the breast.

8 Claims, 8 Drawing Sheets

STRAPLESS SWIMSUIT TOP AND METHOD OF DONNING SAME

BACKGROUND OF THE INVENTION

1. Field of the Invention

This invention relates to swimsuits, and in particular to a strapless swimsuit top and method of donning same.

2. Background of the Invention

Ever since the advent of swimsuits, clothing designers have searched to find more comfortable, functional and aesthetic swimsuit designs. The bikini swimsuit design was a major step forward, in that it afforded women comfort and stylishness not previously available, and at the same time provided an aesthetically pleasing clothing design for the enjoyment of bystanders within eyesight.

Although the bikini top provided a number of advantages over the traditional one-piece swimsuit design, it brought with it a number of problems. One problem is that bikini tops are held in place with straps, and bikini top straps prevent an even tan. They tend to leave white imprints, or tan lines, wherever they cover the skin.

If the wearer of a bikini top wishes to acquire an even tan in a non-clothing optional beach, she must somehow remove the bikini top straps so as to avoid unsightly white tracks across her shoulders, back and/or sides. The problem, of course, then becomes how to retain the bikini cups in place covering the wearer's breasts.

One procedure is for the bikini top wearer to lay down on her stomach, reach behind her back to loosen the bikini top straps, let them fall off her shoulders, and sun tan only on her stomach. When the tanning session is over, the tannist locates the loose bikini top straps, transports their ends behind her back, and re-attaches them.

This procedure comes with a number of drawbacks. On pain of receiving an indecent exposure summons, the tannist is a virtual prisoner in the face-down position. If she were to move appreciably, casual bystanders could get more of a view than they had anticipated.

Laying on one's stomach is not a good way to support the spine. It is much easier on the back to lie on one's back or side—not on one's stomach. Thus, using existing bikini top designs, the price of an even tan could be a sore back.

Of course, another drawback of laying on one's stomach with one's bikini top undone is the temptation this provides to pranksters to suddenly pour a bucket of cold water on the tannist, or to yell "Watch out—spider!", or to provide other such distraction which causes the tannist to leap to her feet, loosing her bikini top in the process. Some pranksters find this temptation irresistible.

Thus, it would be desirable to provide a swimsuit top which does not incorporate straps, so as to avoid the undesirable tanning lines associated with existing bikini top straps. In addition, it would be useful to provide such a strapless swimsuit top which has means of attachment to the wearer's breasts, so as to prevent the unwanted departure of the top. It is important that the strapless swimsuit top function in high humidity conditions (such as when the wearer is swimming or diving).

Finally, during the course of a typical day, a woman's nipples tend to become erect intermittently due to temperature variations, the mood of the woman, stimulation, etc. After a time, they return to a flaccid condition. The cycle may repeat numerous times during the day. Thus, it would be desirable to provide a strapless swimsuit top which allows free expansion and contraction of the wearer's nipples, especially when wet, so as to avoid nipple irritation and chaffing.

Existing Designs

A number of strapless clothing top designs have been proposed for women, but these are generally not for swimsuits, but rather for applications which do not require the immersability. Thus, they would tend to fall off when immersed, which would defeat the purpose of wearing a swimsuit top.

Some existing designs are of the "pasty" variety, used by striptease artists to cover their nipples. While these pasties do not incorporate straps which could cause tan lines, they do have adhesive-covered interiors, which stick to the wearer's nipples and areolas. Because the entire interior of the pasty adheres to the wearer's nipples and areolas, when the wearer's nipples become erect, the pasty tends to pull on both the nipple skin and areola skin, causing the wearer to experience irritation and discomfit.

Thus it would be desirable to provide a strapless swimsuit top which would not irritate the nipples of the wearer. This could be accomplished by not subjecting the wearer's. nipples and areolas to adhesive.

SUMMARY OF THE INVENTION

Accordingly, it is an object of the present invention to provide a strapless swimsuit top which can be immersed in water and remain attached. Design features allowing this object to be accomplished include a layer of waterproof adhesive attached to a fabric layer, and an adhesive backing sheet co-extensive with the waterproof adhesive to protect the waterproof adhesive from contamination prior to use. Advantages associated with the accomplishment of this object include achieving the dual functionality of being able to use the instant strapless swimsuit top to acquire tan-line free tans, and also being able to use the strapless swimsuit top for swimming.

It is another object of the present invention to provide a strapless swimsuit top which will not chafe nor irritate the nipples of the wearer. Design features allowing this object to be accomplished include a waterproof adhesive layer having an adhesive-free nipple area sized to accommodate the nipple of the wearer. A benefit associated with the accomplishment of this object is avoidance of pain and discomfit in the wearer, especially when the wearer's nipples undergo normal daily erection/flaccidity cycles.

It is still another object of this invention to provide a strapless swimsuit top which covers the entire breast of the wearer. Design features enabling the accomplishment of this object include a layer of waterproof adhesive attached to a fabric layer. The fabric layer and waterproof layer are cup-shaped, shaped and sized to accommodate a breast of the wearer. Advantages associated with the realization of this object include the ability of the wearer to wear the strapless swimsuit top while sunning in order to acquire a tan free of unsightly tan lines, and yet also use the strapless swimsuit top as a conventional bikini top, while remaining within the applicable local modesty ordinances.

It is still another object of the present invention to provide method of donning a strapless swimsuit top. Method steps allowing this object to be accomplished include sliding a strapless swimsuit top lower edge up a thorax until positioned at an intersection of the thorax and a breast lower surface, and rolling the strapless swimsuit top up over the breast such that an adhesive-free area coextends with a nipple. Benefits associated with the accomplishment of this object include achieving the dual functionality of being able to use the instant strapless swimsuit top to acquire tan-line free tans, and also being able to use the strapless swimsuit top for swimming.

It is yet another object of the present invention to provide method of donning a strapless swimsuit top which provides uplifting and support to a breast. A method step allowing this object to be accomplished is pulling upward an the strapless swimsuit top while attaching same to a breast. Benefits associated with the accomplishment of this object include providing better breast support, and the aesthetically pleasing appearance of uplifted breasts.

BRIEF DESCRIPTION OF THE DRAWINGS

The invention, together with the other objects, features, aspects and advantages thereof will be more clearly understood from the following in conjunction with the accompanying drawings.

Eight sheets of drawings are provided. Sheet one contains FIGS. 1 and 2. Sheet two contains FIGS. 3 and 4. Sheet three contains FIGS. 5 and 6. Sheet four contains FIGS. 7 and 8. Sheet five contains FIGS. 9 and 10. Sheet six contains FIGS. 11 and 12. Sheet seven contains FIGS. 13 and 14. Sheet eight contains FIG. 15.

DETAILED DESCRIPTION OF THE PREFERRED EMBODIMENT

Figure 1:
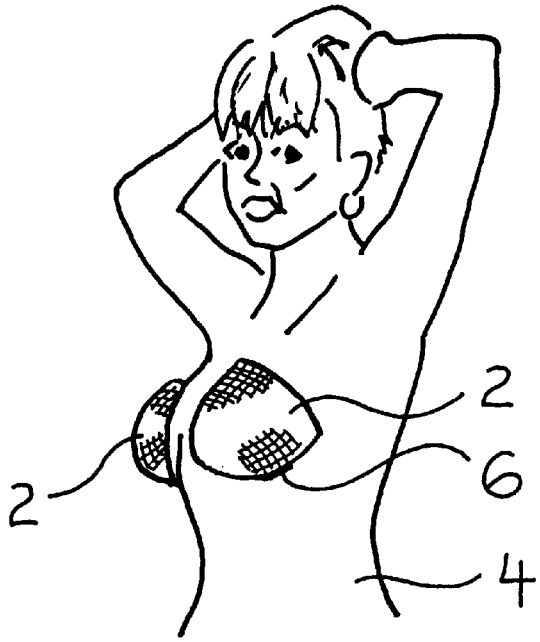
FIG. 1 is a front quarter view of a model wearing a pair of strapless swimsuit tops.
Figure 2:
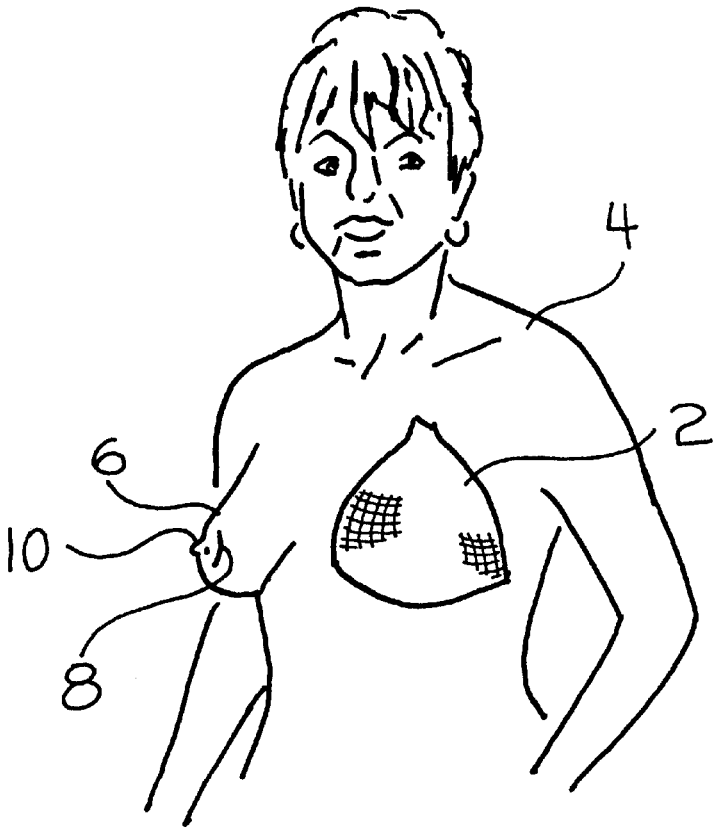
FIG. 2 is a front quarter view of a model wearing a strapless swimsuit top.

FIG. 1 is a front quarter view of model 4 wearing a pair of strapless swimsuit tops 2 on her breasts 6. FIG. 2 is a front quarter view of model 4 wearing a strapless swimsuit top 2 on her right breast 6. As may be observed, it is desirable to not subject the nipple 10 of model 4 to adhesive, in order to prevent nipple 10 irritation. This function is achieved by providing adhesive-free nipple area 16, as may be observed in FIG. 4.

Figure 3:
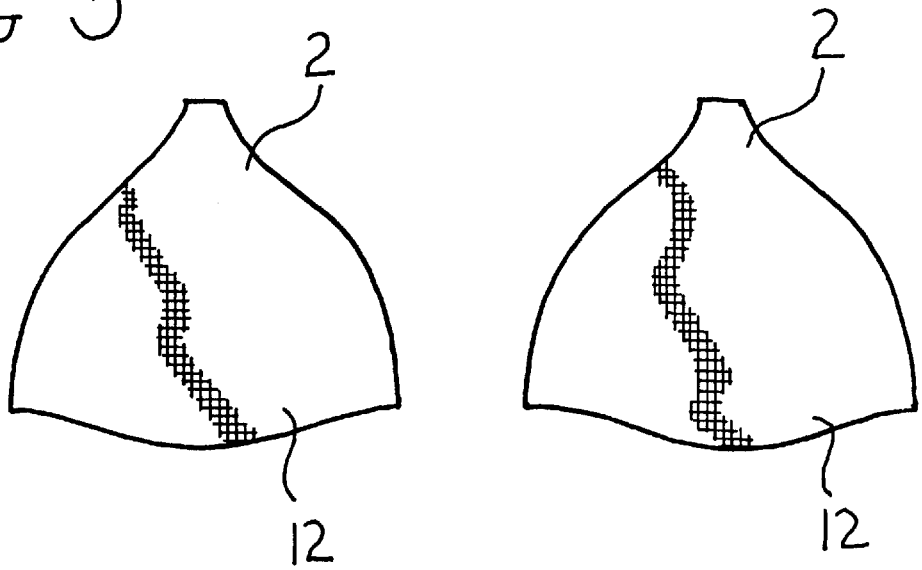
FIG. 3 is a top view of a pair of triangular strapless swimsuit tops.
Figure 4:
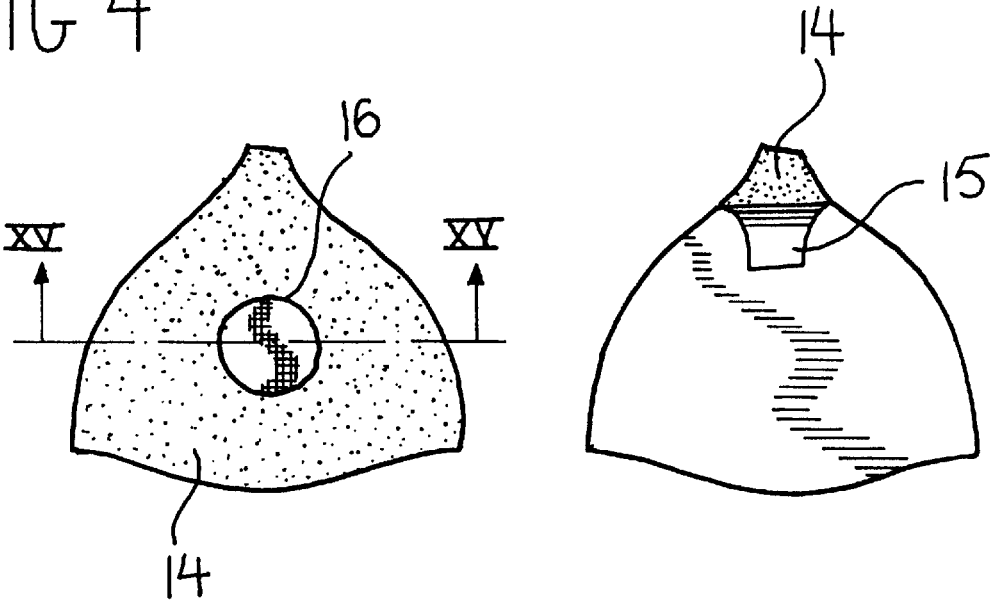
FIG. 4 is a bottom view of a pair of triangular strapless swimsuit tops.

FIG. 3 is a top view of a pair of triangular strapless swimsuit tops 2. FIG. 4 is a bottom view of a pair of triangular strapless swimsuit tops 2. Each strapless swimsuit top 2 comprises fabric 12, one side of which is coated with waterproof adhesive 14. Waterproof adhesive 14 serves to maintain strapless swimsuit top 2 on model 2 breast 6. In the preferred embodiment, waterproof adhesive 14 was a waterproof adhesive similar to that used on waterproof bandaids, although any appropriate waterproof adhesive could be used which is capable of holding strapless swimsuit top 2 in place when submerged it water. Waterproof adhesive 14 is the type of adhesive which leaves no residue on the skin of model 4 after removal of strapless swimsuit top 2, and is not so strong as to cause undue discomfit to model 4 when strapless swimsuit top 2 is removed from model 4 breast 6. Fabric 12 may be swimsuit material, synthetic, or other appropriate material.

Each strapless swimsuit top 2 is provided adhesive-free nipple area 16, which is an area of fabric 12 which is not coated with waterproof adhesive 14. The shape of adhesive-free nipple area 16 corresponds substantially to the shape of model 4 areola 8, and the size of adhesive-free nipple area 16 is slightly larger than model 4 areola 8, although adhesive-free area 16 could be sized to substantially equal the size of nipple 10.

Figure 14:
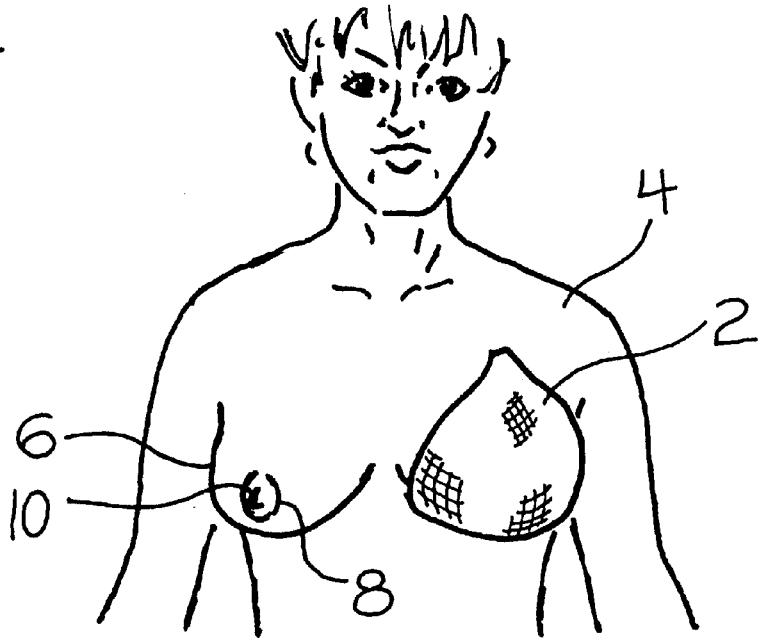
Figure 15:
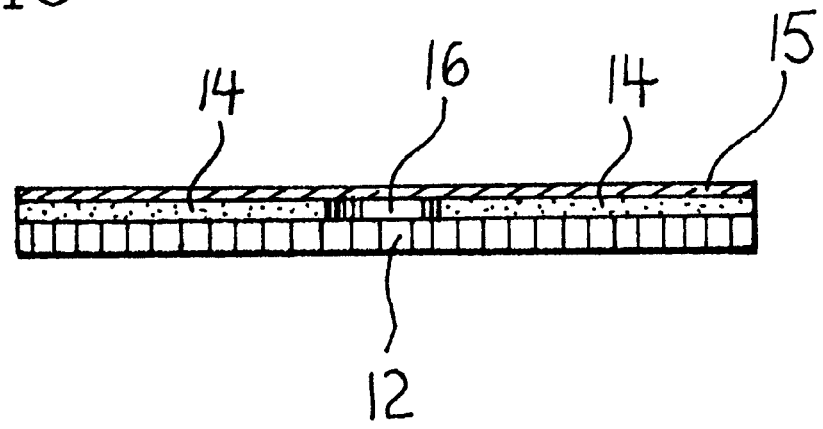
FIG. 15 is a cross-sectional view of a triangular strapless swimsuit top taken at section XV—XV of FIG. 4.

FIG. 15 is a cross-sectional view of a triangular strapless swimsuit top taken at section XV—XV of FIG. 4. As depicted in FIG. 15, waterproof adhesive 14 co-extends with fabric 12 except in adhesive-free nipple area 16. Adhesive backing sheet 15 co-extends with waterproof adhesive 14, and protects same until strapless swimsuit top 2 is to be donned. As may be observed in FIGS. 9–14, when model 4 dons strapless swimsuit top 2, she places strapless swimsuit top 2 so that adhesive-free nipple area 16 co-extends with her nipple 10, thus avoiding any direct contact between waterproof adhesive 14 and nipple 10.

Although any appropriately shaped strapless swimsuit top 2 is considered to be within the scope of this invention, FIGS. 3–8 depict three specific strapless swimsuit top 2 shapes. FIG. 3 is a top view of a pair of triangular strapless swimsuit tops 2. FIG. 4 is a bottom view of a pair of triangular strapless swimsuit tops 2. An adhesive-free nipple area 16 is substantially centrally disposed on each triangular strapless swimsuit top 2.

Figure 5:
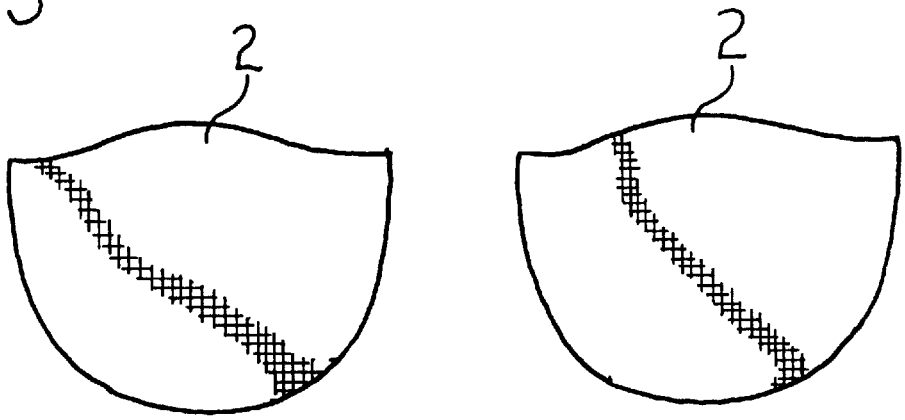
FIG. 5 is a top view of a pair of semi-circular strapless swimsuit tops.
Figure 6:
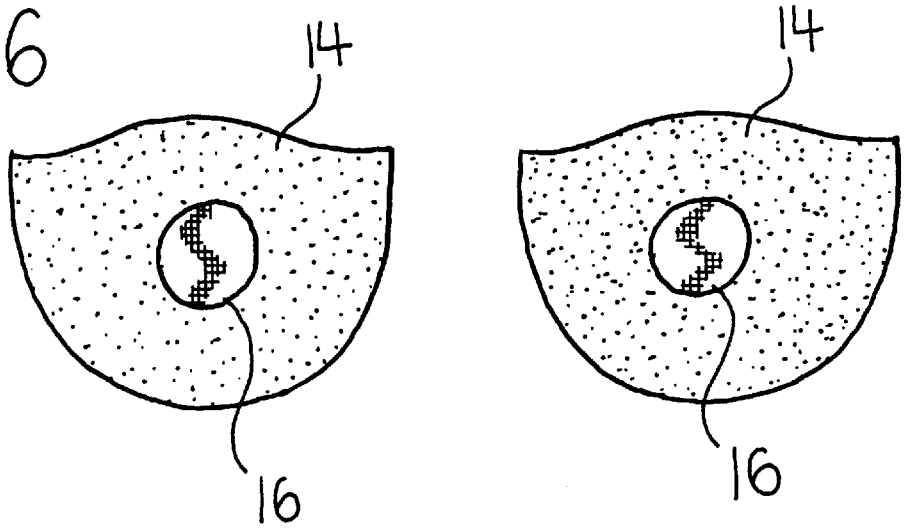
FIG. 6 is a bottom view of a pair of semi-circular strapless swimsuit tops.

FIG. 5 is a top view of a pair of semi-circular strapless swimsuit tops 2. FIG. 6 is a bottom view of a pair of semi-circular strapless swimsuit tops 2. An adhesive-free nipple area 16 is substantially centrally disposed on each semi-circular strapless swimsuit top 2.

Figure 7:
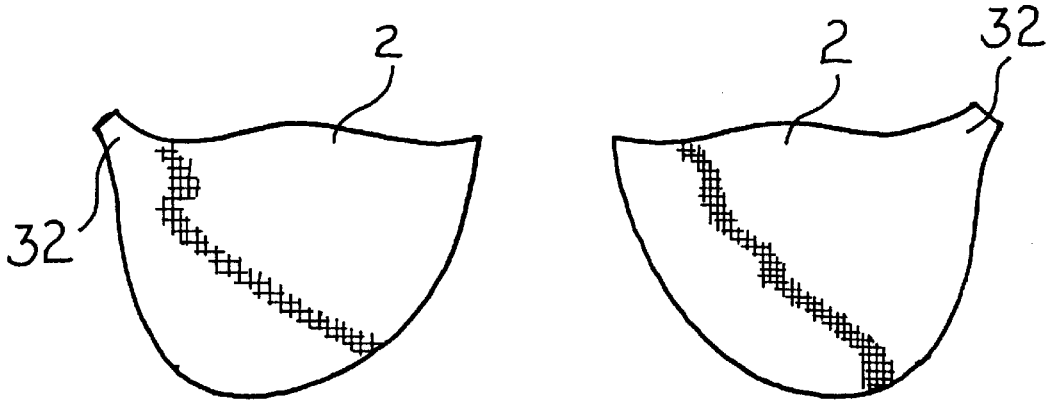
FIG. 7 is a top view of a pair of tabbed semi-circular strapless swimsuit tops.
Figure 8:
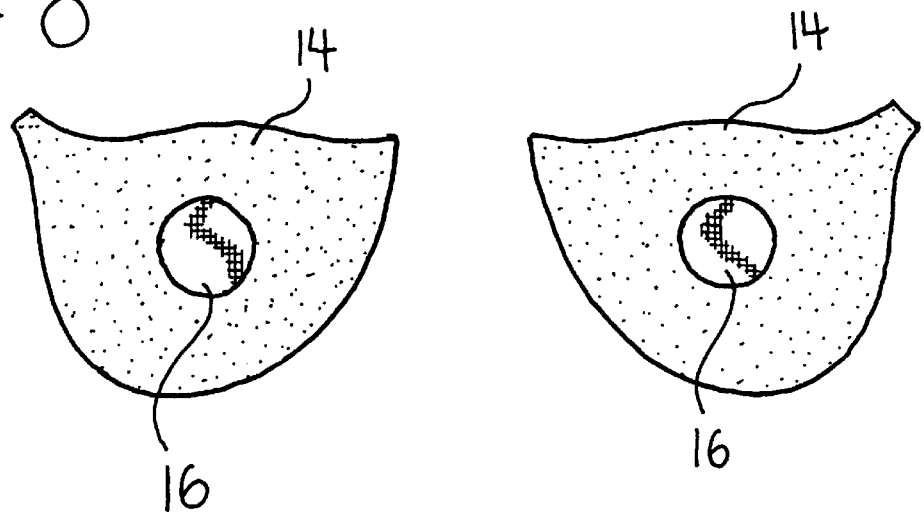
FIG. 8 is a bottom view of a pair of tabbed semi-circular strapless swimsuit tops.
Figure 9:
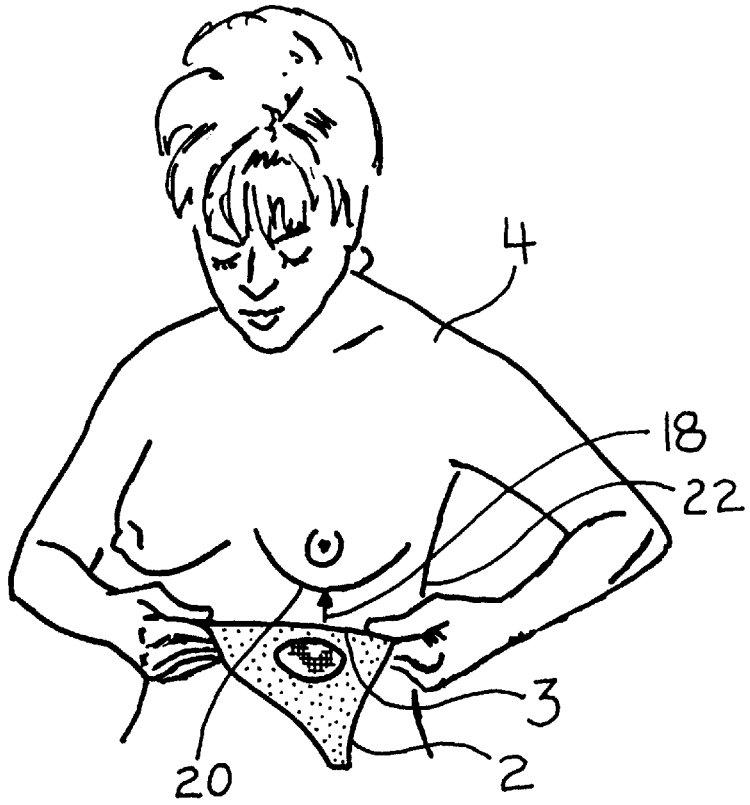
FIGS. 9–14 depict the steps of the instant method of donning a strapless swimsuit top.

FIG. 7 is a top view of a pair of tabbed semi-circular strapless swimsuit tops 2. FIG. 8 is a bottom view of a pair of tabbed semi-circular strapless swimsuit tops. The strapless swimsuit tops 2 depicted in FIGS. 7 and 8 are substantially the same shape as the strapless swimsuit tops 2 depicted in FIGS. 5 and 6, except each tabbed semi-circular strapless swimsuit top 2 of FIGS. 7 and 8 have a tab 32 attached to an upper corner of strapless swimsuit top 2. An adhesive-free nipple area 16 is substantially centrally disposed on each tabbed semi-circular strapless swimsuit top 2.

FIGS. 9–14 depict the steps of the instant method of donning a strapless swimsuit top 2. First, adhesive backing sheet 15 is removed from strapless swimsuit top 2. Then, as may be observed in FIG. 9, model 4 grasps strapless swimsuit top lower edge 3 with her hands, and slides strapless swimsuit top lower edge 3 upwards over her thorax 22 towards breast lower surface 20 as indicated by arrow 18.

Figure 10:
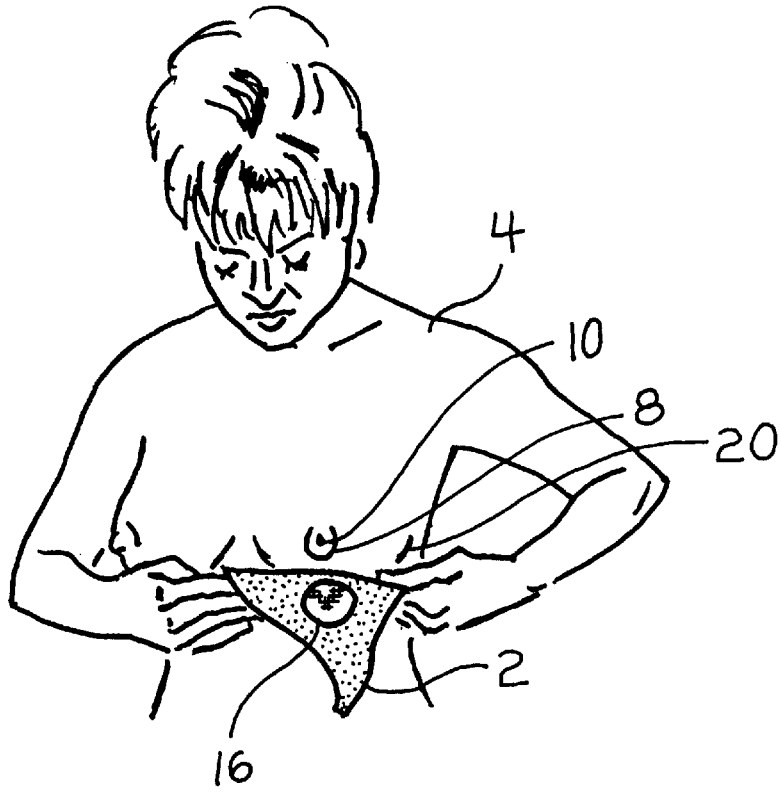

In FIG. 10, model 4 has transported strapless swimsuit top lower edge 3 upwards over her thorax 22 towards breast lower surface 20, until strapless swimsuit top lower edge 3 coincides with the intersection of breast lower surface 20 and thorax 22. Note that adhesive-free nipple area 16 is directly below nipple 10 and areola 8, a sufficient distance away from nipple 10 and areola 8 such that when strapless swimsuit top 2 is rolled up over breast 6, adhesive-free nipple area 16 will coextend at least with nipple 10, and if desired, also with areola 8.

Figure 11:
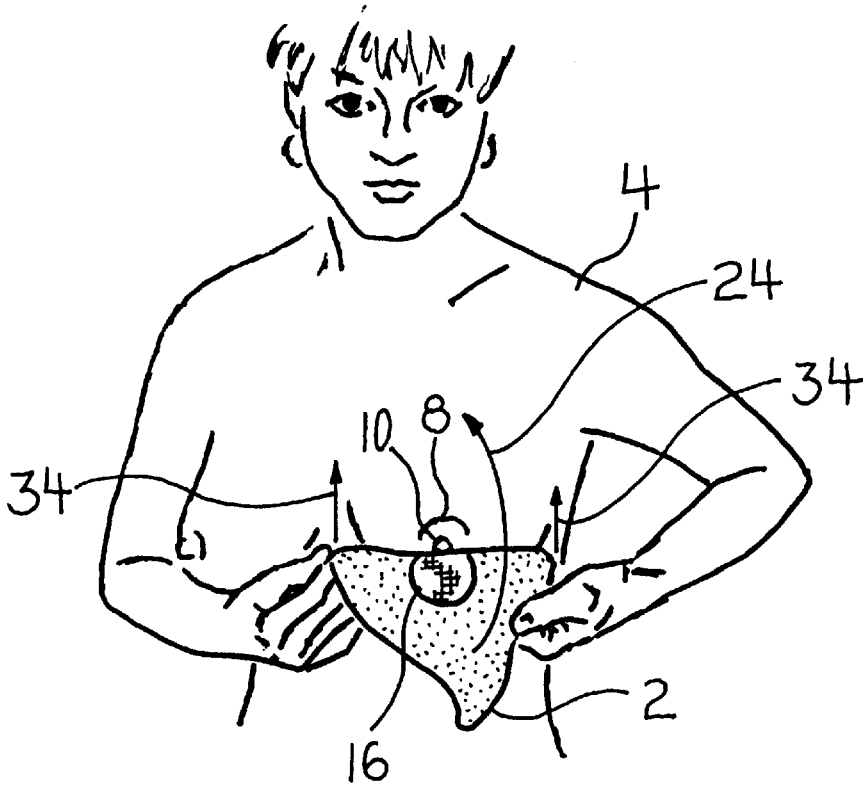

In FIG. 11 model 4 has commenced rolling strapless swimsuit top 2 up over breast 6 as indicated by arrow 24, while optionally simultaneously pulling upwards as indicated by arrows 34. Throughout the donning process, model 4 may pull upwards on strapless swimsuit top 2 as indicated by arrows 34 to afford an uplifting support to breast 6 after the donning process is complete. This uplifting support to breast 6 may be varied depending on the upwards pulling force exerted by model 4 on strapless swimsuit top 2 during the donning process, and thus the amount of uplift provided to breast 6 by strapless swimsuit top 2 after donning can be varied depending on how much of a "push-up" effect model 4 wishes to achieve in her breasts.

Figure 12:
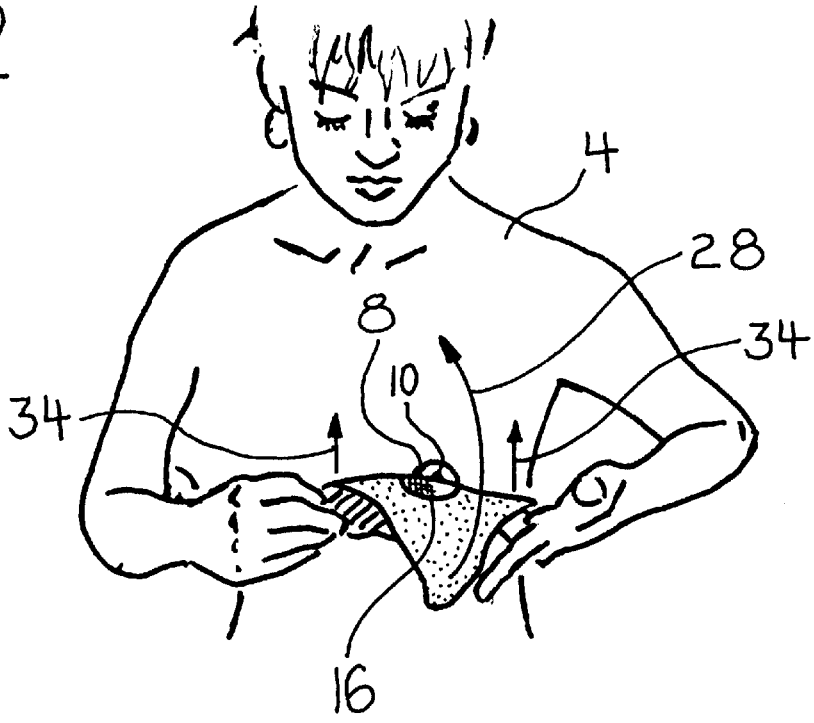

FIG. 12 depicts model 4 continuing to roll strapless swimsuit top 2 over breast 6 as indicated by arrow 28, while still optionally pulling upwards on strapless swimsuit top 2 as indicated by arrows 34. Note that waterproof adhesive 14 maintains strapless swimsuit top 2 in position on breast 6, and that adhesive-free nipple area 16 is positioned co-extensive at least with nipple 10, and with areola 8 if so desired.

Figure 13:
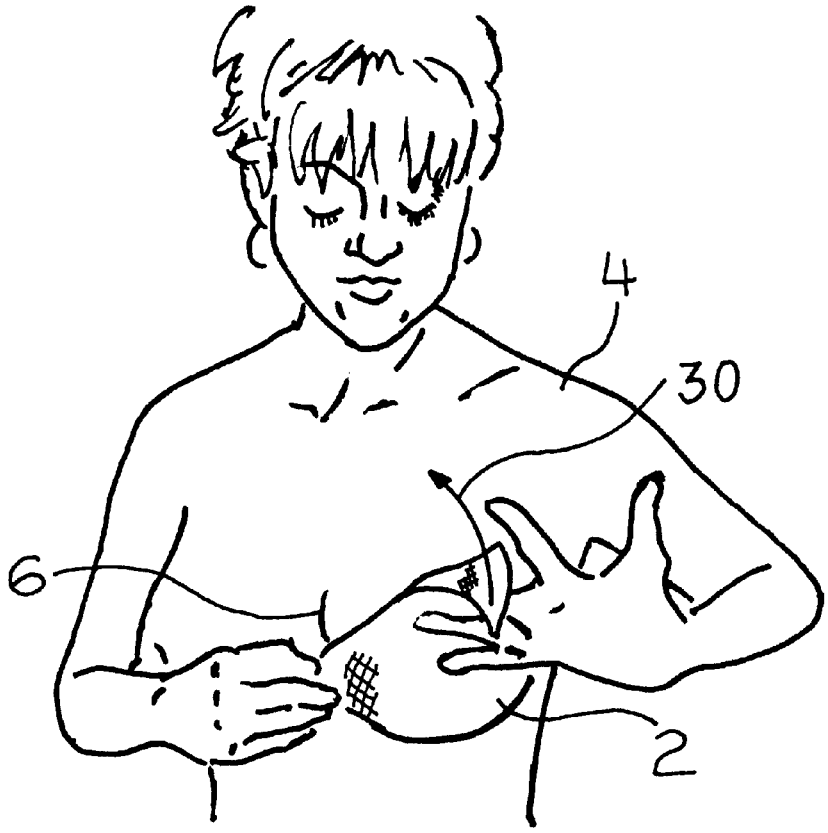

FIG. 13 depicts the final step in donning strapless swimsuit top 2. Model 4 is finishing rolling strapless swimsuit top 2 over breast 6 as indicated by arrow 30. FIG. 14 depicts strapless swimsuit top 2 installed on model 4 left breast 6. Adhesive-free area 16 has been positioned co-extensive with model 4 nipple 10, thus avoiding waterproof adhesive 14 contact with model 4 nipple 10, and thereby preventing chafing and irritation of model 4 nipple 10. While a preferred embodiment of the invention has been illustrated herein, it is to be understood that changes and variations may be made by those skilled in the art without departing from the spirit of the appending claims.

DRAWING ITEM INDEX

2 strapless swimsuit top
3 strapless swimsuit top lower edge
4 model
6 breast
8 areola
10 nipple
12 fabric
14 waterproof adhesive
15 adhesive backing sheet
16 adhesive-free nipple area
18 arrow
20 breast lower surface
22 thorax
24 arrow
28 arrow
30 arrow
32 tab
34 arrow

I claim:

1. A method of donning a strapless swimsuit top, said strapless swimsuit top comprising a fabric cup sized to admit a breast, waterproof adhesive co-extensive with said fabric except for a centrally-disposed adhesive-free nipple area, said adhesive-free nipple area being substantially circular and sized at least as large as a nipple, and an adhesive backing sheet removably attached to said waterproof adhesive, said method of donning a strapless swimsuit top comprising the steps of:

A. Removing said adhesive backing sheet from said waterproof adhesive;

B. Grasping said strapless swimsuit top by a strapless swimsuit top lower edge, and sliding said strapless swimsuit top lower edge upwards over a thorax towards a breast lower surface;

C. Positioning said strapless swimsuit top lower edge at an intersection of said thorax and said breast lower surface such that said adhesive-free nipple area is directly below a nipple, and a sufficient distance away from said nipple that when said strapless swimsuit top is rolled up over said breast, said adhesive-free nipple area will coextend with said nipple;

D. Rolling said strapless swimsuit top up over said breast, taking care to ensure that said nipple is covered by said adhesive-free nipple area, whereby contact between said waterproof adhesive is avoided, thereby preventing chafing and irritation of said nipple.

2. The method of donning a strapless swimsuit top of claim 1 comprising the further step of pulling upwards on said strapless swimsuit top while attaching said strapless swimsuit top to said breast, whereby an uplifting support may be afforded to said breast by said strapless swimsuit top, the amount of said uplifting provided to said breast by said strapless swimsuit top depending on an amount of force with which said strapless swimsuit top is pulled upwards.

3. The method of donning a strapless swimsuit top of claim 2 wherein said adhesive-free nipple area is shaped like an areola and sized at least as large as said areola, and wherein said method comprises the further step of attaching said strapless swimsuit top to said breast such that said adhesive-free nipple area covers said areola after said strapless swimsuit top has been donned.

4. A strapless swimsuit top comprising a fabric cup sized to admit a breast, waterproof adhesive co-extensive with said fabric except for a centrally-disposed adhesive-free nipple area, said adhesive-free nipple area being substantially circular and sized at least as large as a nipple, and an adhesive backing sheet removably attached to said waterproof adhesive, whereby said strapless swimsuit top may be removably attached to a breast after removal of said adhesive backing sheet.

5. The strapless swimsuit top of claim 4 wherein said strapless swimsuit top is shaped like a triangle, said adhesive-free nipple area being substantially centrally disposed on said strapless swimsuit top.

6. The strapless swimsuit top of claim 4 wherein said strapless swimsuit top is shaped like a semi-circle, said adhesive-free nipple area being substantially centrally disposed on said strapless swimsuit top.

7. The strapless swimsuit top of claim 4 wherein said strapless swimsuit top is shaped like a semi-circle and further comprises a tab attached to an upper corner, said adhesive-free nipple area being substantially centrally disposed on said strapless swimsuit top.

8. The strapless swimsuit top of claim 4 wherein said adhesive-free area is shaped substantially like an areola, and sized to be at least as large as said areola, whereby said areola may be protected from chafing and irritation when said strapless swimsuit top is donned.

* * * * *